US006539824B2

(12) United States Patent
Wedhorn

(10) Patent No.: US 6,539,824 B2
(45) Date of Patent: Apr. 1, 2003

(54) WELDING CHIP HAMMER WITH REPLACEMENT POINT

(76) Inventor: Charles D. Wedhorn, 2100 N. Cloverhill, Jackson, MI (US) 49201

( * ) Notice: Subject to any disclaimer, the term of this patent is extended or adjusted under 35 U.S.C. 154(b) by 0 days.

(21) Appl. No.: 09/863,782

(22) Filed: May 24, 2001

(65) Prior Publication Data

US 2002/0174747 A1 Nov. 28, 2002

(51) Int. Cl.[7] ..... B25D 1/00; B25D 3/00

(52) U.S. Cl. ..... 81/25; 81/26; 279/99; 30/167.1

(58) Field of Search ..... 81/20, 25, 26, 81/490, 177.4; 7/144, 146, 143, 147; 30/167.1, 167, 168; 279/32, 89–91, 99, 101

(56) References Cited

U.S. PATENT DOCUMENTS 982,832 A * 1/1911 Kuhn ..... 279/99
2,349,741 A * 5/1944 McLaughlin ..... 279/89
2,423,189 A * 7/1947 Honhart ..... 81/25 X
2,537,244 A * 1/1951 Swett ..... 81/120 X
2,655,921 A * 10/1953 Haboush ..... 81/463 X
3,900,058 A * 8/1975 McArdle ..... 279/438 X
5,219,250 A * 6/1993 Voorhees ..... 279/91 X

OTHER PUBLICATIONS

The Random House College Dictionary, revised edition, Copyright 1980, 1979, 1975, p. 883.*

* cited by examiner

*Primary Examiner*—D. S. Meislin
(74) *Attorney, Agent, or Firm*—Young & Basile, P.C.

(57) ABSTRACT

A chipping hammer for removing oxidation and slag from a welding bead, usually an arc welding bead, wherein the hammer includes a long lasting narrow replaceable chipping point economically formed by a hardened nail. Easily operated attachment means removably maintain the point on the hammer head.

2 Claims, 2 Drawing Sheets

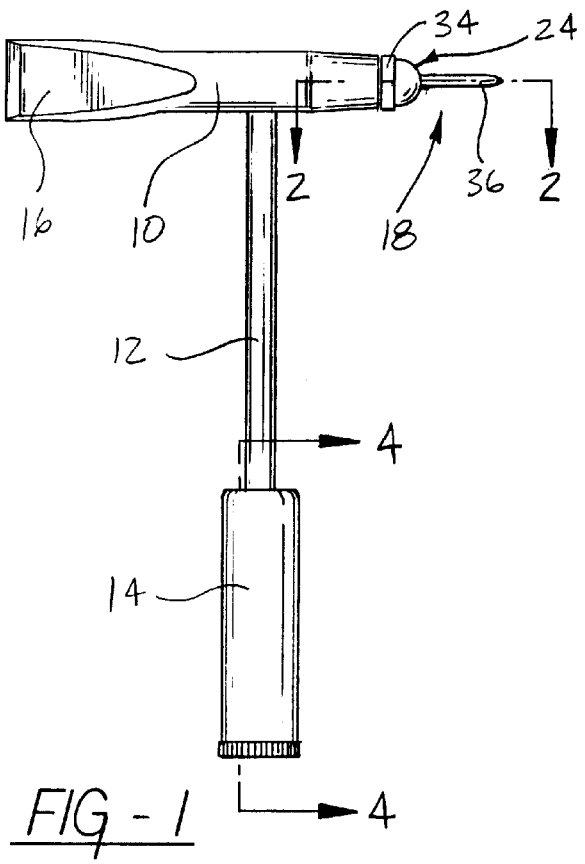
FIG - 1
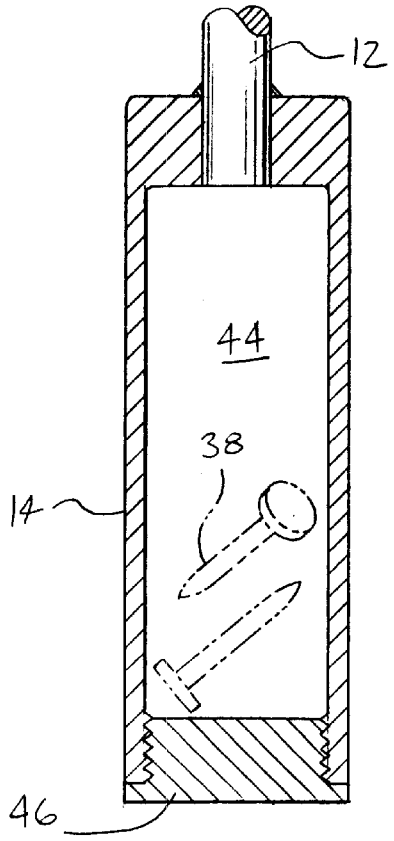
FIG - 4
FIG - 2
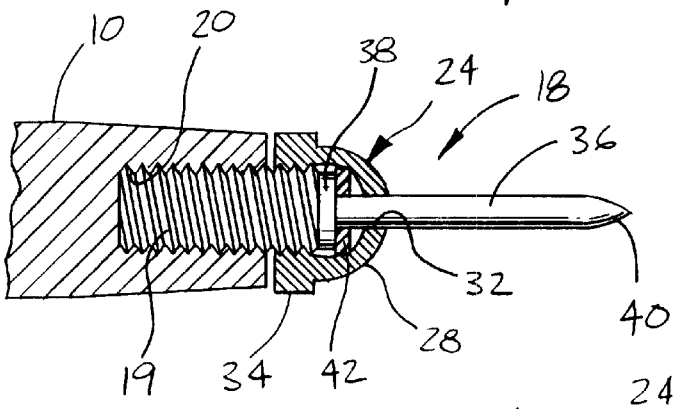
FIG - 3
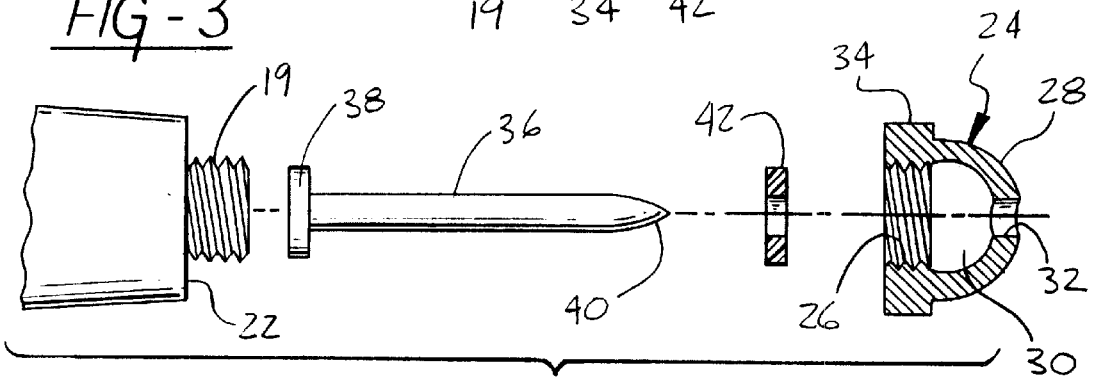

WELDING CHIP HAMMER WITH REPLACEMENT POINT

FIELD OF THE INVENTION

The invention pertains to manually held chip hammers for removing oxidation and slag from a welding site wherein the hammer includes an easily replaceable point.

DESCRIPTION OF THE RELATED ART

Chip hammers are a necessary tool for those performing arc welding. A slag forms over the welding bead, and if additional weld passes are to be taken, the slag must be first removed by a chip hammer to provide a bare metal surface for subsequent welding operations.

A conventional welding chip hammer includes an elongated head mounted on the end of a handle. One end of the hammer head is usually in the form of a chisel, and the other end of the hammer head is ground to a point. The pointed end is necessary as it permits the hammer to be effective in close quarters and to strike small portions of the slag to be removed. However, because the slag is very hard and roughly surfaced, the chip hammer pointed end quickly dulls and must be resharpened by grinding the hammer head. Continuous regrinding or resharpening the pointed hammer head end is time consuming and depletes the mass of the hammer head periodically requiring discarding of the chip hammer for replacement by an entirely new hammer including head and handle.

Accordingly, conventional weld chip hammers create an expensive non-obvious cost in arc welding operations due to the time required to grind and resharpen hammer head points, and as dull points do not effectively remove many types of slag configurations, defective welds may result from dull chip hammer points.

Heretofore, the aforedescribed problem with respect to welding chip hammer pointed ends has not been successfully solved.

OBJECTS OF THE INVENTION

It is an object of the invention to provide an inexpensive welding chip hammer having a replaceable sharp point eliminating the necessity to regrind or discard welding chip hammers because of dull points.

Another object of the invention is to provide a welding chip hammer having a replaceable sharp point wherein the point is formed of an inexpensive commercially available hardened nail, and the practice of the invention substantially reduces welding costs arising from dull welding chip hammers.

SUMMARY OF THE INVENTION

A welding chip hammer in accord with the invention includes the usual elongated hammer head having a chisel configuration at one end, and a point at the other. A handle stem is connected to the head intermediate its ends and a handle grip is attached to the outer end of the stem. In this sense, the general configuration of a chip hammer in accord with the invention corresponds with a conventional chip hammer, and no new skills need to be developed in using the chip hammer constructed in accord with the inventive concepts.

The chip hammer of the invention departs from conventional construction in that the non-chisel end of the head is provided with attachment means by which a sharp replaceable point may be quickly affixed to the hammer head end by the use of conventional tools and ordinary mechanical skills.

The replaceable chip hammer point attachment means includes a blind threaded hole formed in the hammer end usually coaxial with the hammer head axis. The threaded hole terminates in a closed end. Two embodiments of attachment means within the inventive concepts are illustrated. In one embodiment, a stud is threaded into the head threaded hole. In the other embodiment, a fitting is threaded into the hole for maintaining the point in position.

The point removably attached to the hammer head end is preferably in the form of a conventional hardened nail having a head defining a shoulder at one end, and a pointed end at the other. Such a hardened nail, usually of approximately two inches in length, is readily available at most hardware stores as the same are used to be driven into concrete by hammer or explosive charge. Such nails have a high strength, and are capable of maintaining a sharp point over long periods of time when used to engage arc welding slag.

In one embodiment, a threaded cap is mounted on a threaded stub screwed into the head hole and the cap has a hole therein wherein the pointed end of the nail is inserted through the cap hole, and the cap maintains the nail headed end against the stud outer end, which defines an anvil surface to limit nail movement toward the hammer head. Preferably, an annular washer of a resilient construction is located within the cap about the nail to align the nail within the cap prior to tightening of the cap, and give additional lateral support to the nail.

In the other embodiment of the invention, a tubular threaded fitting receives the nail pointed end and is of a length sufficiently less than the nail length so that the nail point extends beyond the fitting. The diameter of the fitting thread is less than the diameter of the nail head wherein threading of the fitting into the hammer head threaded hole results in the nail head being firmly held against the bottom surface of the head threaded hole which defines an anvil surface preventing nail movement. The extension of the nail pointed end past the fitting makes the nail pointed end available for weld slag chipping purposes.

Preferably, the hammer grip includes an interior hollow chamber having a closeable opening wherein spare points may be stored within the chip hammer grip for quick use at the welding site.

A welding chip hammer constructed in accord with the invention provides an inexpensive welding tool capable of maintaining a sharp point during use, and it is to be appreciated that the objects and advantages of the invention have been achieved.

BRIEF DESCRIPTION OF THE DRAWINGS

The aforementioned objects and advantages of the invention will be appreciated from the following description and accompanying drawings wherein:

FIG. 1 is an elevational view of one embodiment of the welding chip hammer of the invention, FIG. 2 is a plan sectional view as taken along Section 2—2 of FIG. 1, FIG. 3 is a detail elevational, partially sectioned, exploded view of the replaceable point structure as shown in FIGS. 1 and 2, FIG. 4 is a sectional view taken through the hammer grip along Section 4—4 of FIG. 1 illustrating spare points within the grip.

DESCRIPTION OF THE PREFERRED EMBODIMENTS

Figure 5:
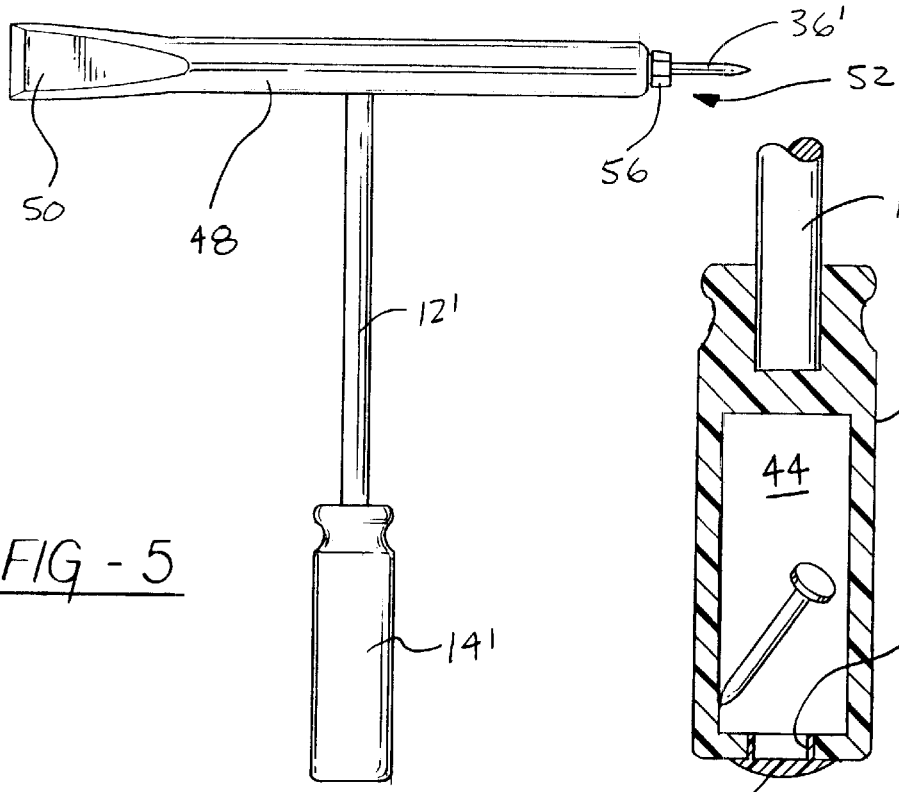
FIG. 5 is an elevational view of another embodiment of a welding chip hammer including the concepts of the invention.
Figure 8:
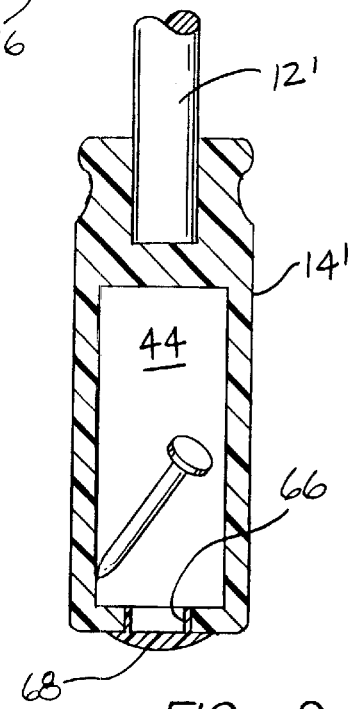
FIG. 8 illustrates the grip shown in FIG. 5 having a chamber defined therein for spare nail points.

A chip hammer utilizing the concepts of the invention is shown in elevation in FIG. 1 wherein the head 10 is mounted upon a shank 12 having a hand grip 14 permitting the tool to be used in the normal hammer manner.

The head 10, at one end, includes the usual chisel-shaped end 16, and the other end of the head constitutes the pointed end assembly 18. As will appreciated, the pointed end 18 constitutes an assembly of several parts as later described.

The head end at assembly 18 is squared off with respect to the length of the elongated head, and a threaded blind hole 20 is formed within the head end which receives a threaded stud 19. The outer end of the threaded stud 19 is formed with a flat end surface 22, FIG. 3, which serves as an anvil to absorb forces imposed upon the head by the tool point as later apparent.

A cap 24 of a configuration similar to a conventional crown nut includes interior threads 26 so as to be threadable upon the outer end of stud 19. The cap threads 26 are axially symmetrically aligned with the cap convex crown 28 which defines an interior concave chamber 30 and a hole 32 centrally extends through the crown 28 as will be apparent from FIG. 3. The cap 24 is provided with a hexagonal surface 34 whereby a wrench may be applied for tightening the cap upon the stud 19.

The tool point 36 is formed by a conventional nail, preferably of the hardened type such as a conventional concrete nail adapted to be driven into a wall or floor. The point 36 includes a shoulder or head end 38 and the usual pointed end 40. An annular positioning ring 42 is located within the cap chamber 30, and the ring 42 is preferably formed of polyurethane or other resilient material.

The tool pointed end 18 is assembled as will be appreciated from FIGS. 2 and 3. By orienting the parts as shown in exploded view FIG. 3, the point sharp end 40 may be inserted through the positioning ring 42 and the cap hole 32. Upon complete insertion of the point head 38 into the cap 24, the cap may be threaded upon the stud 19 and tightened thereon. Tightening of the cap causes the positioning ring 42 to engage the internal concave surface of cap chamber 30 forcing the point head 38 against the stud anvil surface 22 as shown in FIG. 2, to complete the assembly.

When fully assembled as shown in FIG. 2, the point 36 is rigidly attached to the stud 19 of the tool head 10, and as the preferred length of the point 36 is approximately one and one-half to two inches, a significant portion of the point 36 extends beyond the cap 24 whereby the point 36 may be used to chip slag from a welding site. The hardened nature of the point 36 permits the point to have a long wear life, and the point end 36 will retain its shape and sharpness much longer than points previously ground upon a head of a conventional welding chip hammer.

Use of the positioning ring 42 is optional, and the assembly shown in FIG. 2 can be accomplished without use of the ring 42. The ring helps to initially maintain the point 36 within the cap 24, but if the ring 42 is omitted from the assembly, the point head 38 will directly engage the wall defining chamber 30 which maintains the head 38 against the stud end surface 22.

Preferably, a chamber 44 is defined within the grip 14, FIG. 4, and a threaded removable plug 46 provides access to the chamber 44. As shown in phantom lines, spare points 36 can be stored within the chamber 44.

Another embodiment of a welding chip hammer utilizing concepts of the invention is shown in FIGS. 5–8. In this embodiment, components substantially identical to those described above are indicated by primed reference numerals.

Figure 6:
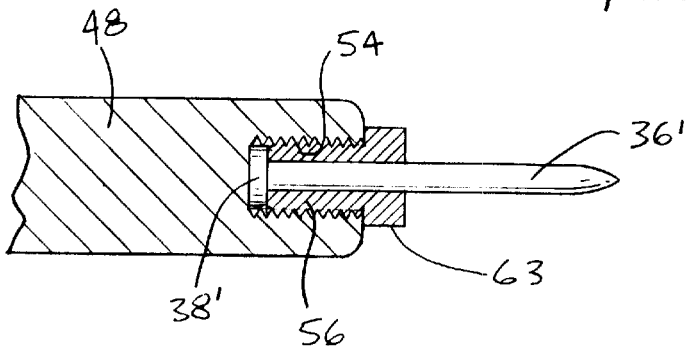
FIG. 6 is a detail sectional elevational view of the attachment means of the embodiment of FIG. 5 as assembled.
Figure 7:
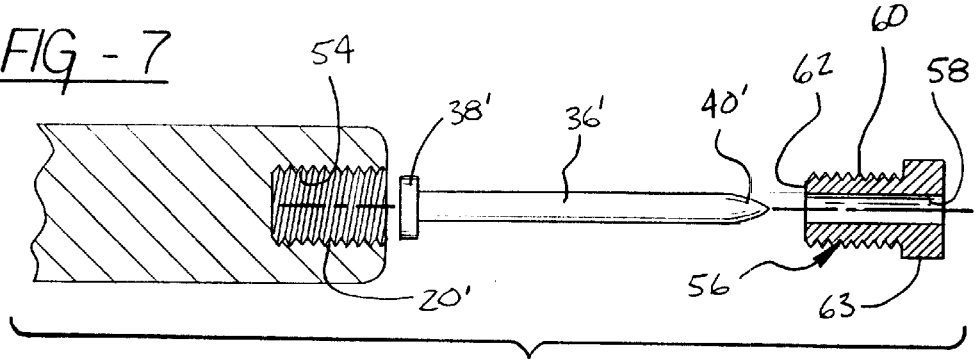
FIG. 7 is a detail, exploded, partially sectioned view of the attachment means of FIGS. 5 and 6.

In the embodiment of FIG. 6, the hammer head 48 can be made from a conventional cold chisel having a chisel end 50, and the pointed end assembly is represented at 52. As shown in FIGS. 6 and 7, a threaded blind hole 54 is formed in the head end in a manner similar to the hole 20 of FIGS. 1–4.

A fitting 56, of the type commonly used in hydraulic systems, includes a cylindrical bore 58, exterior threads 60 and an abutment end 62 lying in a plane perpendicular to the longitudinal axis of the fitting 56. The fitting 56 is provided with a hexagonal portion 63 whereby a wrench may be applied to the fitting for tightening thereof.

The pointed end assembly 52 is assembled as will be apparent from FIGS. 6 and 7. The point 36', preferably comprising a headed concrete nail, includes the head 38' and the pointed end 40'. The diameter of the point 36' is slightly less than the diameter of the fitting bore 58 wherein the point 36' is received within the bore 58 as will be appreciated from FIG. 6. The fitting 56 is tightened into the blind threaded hole 54 and engages the point headed end 38' forcing the point head against the bottom 54 of the threaded hole 20' wherein the threaded hole end 54 constitutes the anvil surface for supporting the point 36' during use. Of course, the diameter of the threaded portion of the 56 is slightly greater than the diameter of the point head 38' to permit the assembly shown in FIG. 6. The embodiment of FIGS. 5 and 6 is a little less expensive to produce than the embodiment of FIGS. 1–3 as only two components are required.

The tool handlegrip 14' is provided with a chamber 44' having an access hole 66 which is closed by a removable plug 68 permitting extra points 36' to be located within the chamber.

From the above description, it will be appreciated that the invention permits a welding chip hammer to be economically manufactured having a replaceable point. Because the point constitutes a conventional hard concrete nail, such points are inexpensive, and yet very durable, and as the assembly procedure for either embodiment is simple, the replacement of points is well within the skill of an arc welder operator.

It will be appreciated that various modifications to the inventive concepts may be apparent to those skilled in the art without departing from the spirit and scope of the invention.

What is claimed is:

1. A welding chip hammer comprising, in combination, an elongated head having an axis and having first and second ends, a handle affixed to said head, releasable point attachment means defined on said head first end, and a replaceable point having ends adapted to be releasably attached at said point attachment means, said point having an inner end engaging said releaseable point attachment means and an outer end axially extending beyond said releaseable point attachment means, said replaceable point comprising the nail having a headed end and a point end, said headed end comprising said point inner end and said point end comprising said point outer end, said point attachment means including a blind threaded hole defined in said first end, and annular threaded member received within said blind threaded hole, and said threaded member including a stud having an inner end received within said hole and an outer end extending from said hole, a cap threaded on said threaded member having a hole defined therein, said nail point outer end extending through said cap hole whereby said cap maintains said nail headed end of said point against said threaded member, said point other end axially extending beyond said cap.

2. A welding chip hammer as in claim 1, an annular positioning ring within said cap encircling said point centrally positioning said point within said cap.

* * * * *

UNITED STATES PATENT AND TRADEMARK OFFICE

CERTIFICATE OF CORRECTION

PATENT NO. : 6,539,824 B2
DATED : April 1, 2003
INVENTOR(S) : Wedhorn

It is certified that error appears in the above-identified patent and that said Letters Patent is hereby corrected as shown below:

Title page,
Item [57], ABSTRACT,
Line 5, delete “maintain” and insert -- maintains --;

Column 2,
Line 23, delete “stub” and insert -- stud --;
Line 61, delete “detail” and insert -- detailed --;

Column 3,
Lines 4 and 7, delete “detail” and insert -- detailed --;
Line 20, after “will,” please insert -- be --;
Line 33, after “30,” please insert -- , --; and Column 4,
Line 41, delete “handlegrip” and insert -- hand grip --.

Signed and Sealed this

Fifth Day of August, 2003

JAMES E. ROGAN
*Director of the United States Patent and Trademark Office*